US007726788B2

(12) United States Patent
Akahane

(10) Patent No.: US 7,726,788 B2
(45) Date of Patent: Jun. 1, 2010

(54) INK SUPPLY NEEDLE FOR A LIQUID EJECTING HEAD AND LIQUID EJECTING APPARATUS

(75) Inventor: Fujio Akahane, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 434 days.

(21) Appl. No.: 11/753,395

(22) Filed: May 24, 2007

(65) Prior Publication Data

US 2007/0273730 A1 Nov. 29, 2007

(30) Foreign Application Priority Data

May 24, 2006 (JP) ..... 2006-143738

(51) Int. Cl.
*B41J 2/175* (2006.01)

(52) U.S. Cl. ..... 347/85; 347/93; 347/17

(58) Field of Classification Search ..... 347/17, 347/68, 70–72, 84–87, 93
See application file for complete search history.

(56) References Cited

U.S. PATENT DOCUMENTS 6,749,296 B2 * 6/2004 Usui et al. ..... 347/93
2002/0044181 A1 4/2002 Suenaga et al.

FOREIGN PATENT DOCUMENTS

| | | |
|---|---|---|
| EP | 1170131 A2 | 1/2002 |
| EP | 1520711 A1 | 4/2005 |
| EP | 1541359 A1 | 6/2005 |
| JP | 09-085960 | 3/1997 |
| JP | 10-193646 | 7/1998 |
| JP | 2001-113721 | 4/2001 |
| JP | 2003-011384 | 1/2003 |
| JP | 2004-284239 | 10/2004 |
| JP | 2006-095817 | 4/2006 |

* cited by examiner

*Primary Examiner*—Juanita D Stephens
(74) *Attorney, Agent, or Firm*—Workman Nydegger

(57) ABSTRACT

A liquid ejecting head which is formed by joining a liquid introducing member for introducing liquid and a base body by welding includes an introduction hole which is formed in a front end of the liquid introducing member and an extending section which is tilted to extend from the exterior edge of an introduction hole to the inside of the introduction hole.

4 Claims, 5 Drawing Sheets

INK SUPPLY NEEDLE FOR A LIQUID EJECTING HEAD AND LIQUID EJECTING APPARATUS

BACKGROUND

1. Technical Field

The present invention relates to a liquid ejecting apparatus such as an inkjet-type recording device, a display device manufacturing apparatus, an electrode forming apparatus, or a bio chip manufacturing apparatus and a liquid ejecting head installed in the liquid ejecting apparatus.

2. Related Art

Ink jet printers serving as liquid ejecting apparatuses appropriate for printing on paper are well known. Generally, ink jet printers have a configuration in which a liquid ejecting head having fine nozzles for ejecting liquid (liquid droplets) is loaded onto a carriage reciprocating with respect to printing paper. For example, in a liquid ejecting head disclosed in JP-A-10-193646, an ink supply needle (liquid introducing member) combined with a supply section of an external ink cartridge for introducing ink is provided.

The ink supply needle is a member having the shape of a hollow needle in which a plurality of introduction holes are formed on peripheral surface of a cone-shaped apex portion. The peripheral surface of the apex portion serves as a guide when the ink supply needle is inserted into a supply hole of the ink cartridge, and ink can be introduced from the ink cartridge through an introduction hole.

The introduction hole of the ink supply needle is a spot that causes pressure loss (flow resistance) at a time when the ink is introduced, and accordingly, it is preferable that the inside diameter of the introduction hole increases to some degree from the viewpoint of the reduction of pressure loss. However, as the diameter of the introduction hole increases, a partition wall between the introduction hole and an adjacent introduction hole becomes thinner, and thus, there may be a case where the partition wall between adjacent introduction holes is broken at a time when the ink supply needle is welded to the base body (case) of the liquid ejecting head using an ultrasonic welding method.

SUMMARY

An advantage of some aspects of the invention is that it provides a liquid ejecting head and a liquid ejecting apparatus which have an excellent resistance to ultrasonic welding and can reduce the pressure loss at a time when liquid is introduced.

According to an aspect of the invention, there is provided a liquid ejecting head which is formed by joining a liquid introducing member for introducing liquid and a base body. The liquid ejecting head includes an introduction hole which is formed in a front end of the liquid introducing member and an extending section which is tilted to extend from an exterior edge of the introduction hole to the inside of the introduction hole.

The liquid ejecting head according to the aspect of the invention does not have a partition wall portion, that is a structure according to general technology, around the introduction hole, and accordingly, shows excellent resistance to ultrasonic welding. In addition, since the introduction hole can be prepared sufficiently large in the center of an end portion of the liquid introducing member, a high pressure loss does not occur. In addition, the extending section which is tilted to extend from the exterior edge of the introduction hole to the inside of the introduction hole can serve as a guide when the liquid introducing member is inserted into a supply section of an external liquid supply unit.

It is preferable that the liquid ejecting head includes a plurality of extending sections disposed to be symmetrical with respect to the introduction hole.

It is more preferable that the liquid ejecting head includes three to four extending sections.

In this case, when the liquid introduction member of the liquid ejecting head is inserted into the supply section of the liquid supply unit, the liquid introducing member is guided without inclining to one of the plurality of extending sections. In the case, when the number of the extending sections is too small, inclining of the guide position occurs, and when the number of the extending sections is too large, the sizes of the extending sections decrease to result in the decrease in the strength thereof. Accordingly, it is preferable that the number of the extending sections is three to four.

It is preferable that the front end of the extending section has a round shape.

In this case, the concentration of the ultrasonic energy in the front end of the extending section is suppressed, and accordingly, the resistance of the liquid ejecting head to ultrasonic vibrations becomes excellent.

According to another aspect of the invention, there is provided a liquid ejecting apparatus that includes the above-described liquid ejecting head.

The liquid ejecting apparatus according to the another aspect of the invention does not have a partition wall portion, that is a structure according to general technology, around the introduction hole, and accordingly, shows excellent resistance to ultrasonic welding. In addition, since the introduction hole can be prepared sufficiently large in the center of an end portion of the liquid introducing member, a high pressure loss does not occur. In addition, the extending section which is tilted to extend from the exterior edge of the introduction hole to the inside of the introduction hole can serve as a guide when the liquid introducing member is inserted into a supply section of an external liquid supply unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the preferred embodiments of the present invention will be described in detail with reference to the accompanying drawings.

Since the embodiments described below are concrete examples of the invention, various limits that are technically preferable are added, but the scope of the invention is not limited thereto unless there is an explicit description for limiting the scope of the invention. In the figures referred to in the following description, the vertical and horizontal scales of a member or a portion may be represented different from actual scales for the convenience of description.

Configuration of Liquid Ejecting Apparatus

First, the configuration of a liquid ejecting apparatus according to an embodiment of the invention will be described with reference to FIG. 1.

Figure 1:
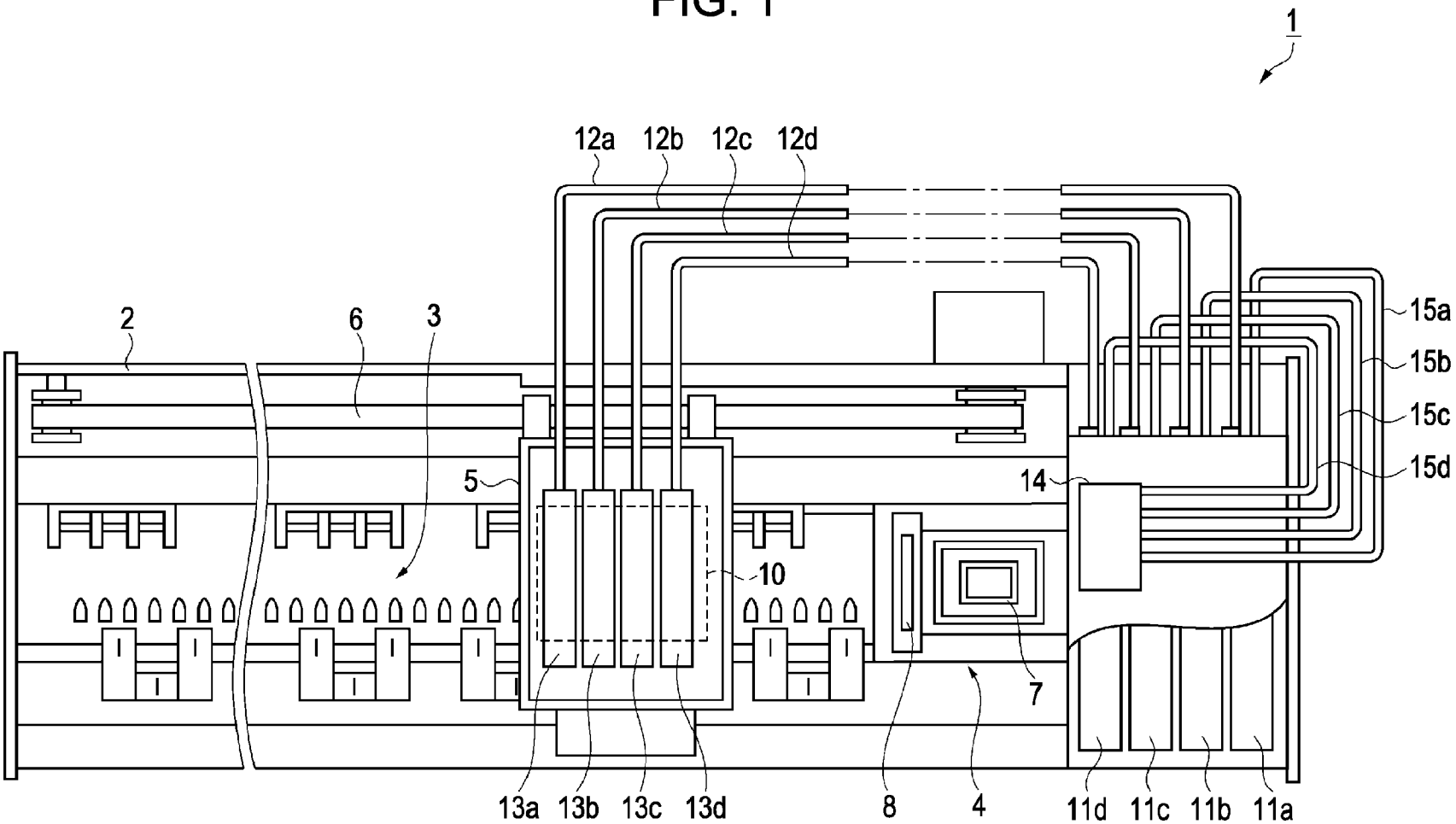
FIG. 1 is a schematic plan view showing an external configuration of a liquid ejecting apparatus according to an embodiment of the invention.

FIG. 1 is a schematic plan view showing an external configuration of the liquid ejecting apparatus.

In FIG. 1, a printer 1 serving as the liquid ejecting apparatus includes a guide frame 2 formed by a steel plate and the like, a platen 3 for supporting paper (not shown), a liquid ejecting head 10 that has fine nozzles on one side facing the platen 3, and a maintenance unit 4 for performing a maintenance operation for maintaining the nozzles of the liquid ejecting head 10. The liquid ejecting head 10 is loaded onto a carriage 5 and is reciprocated (scanned) by a driving belt 6 in left-to-right/right-to-left directions in the figure.

Four color inks (ink) are respectively supplied as liquids from ink cartridges 11*a* to 11*d* to the liquid ejecting head 10 through supply tubes 12*a* to 12*d* and pressure control units 13*a* to 13*d*. The ejection from each nozzle of the liquid ejecting head 10 is controlled in synchronization with the scanning of the carriage 5 and transport of the paper (not shown) so as to perform color printing on the paper (not shown) on the platen 3.

The maintenance unit 4 includes a cap 7 that seals (capping) openings of nozzles by closely contacting a nozzle forming surface of the liquid ejecting head 10 and a wiper blade 8 that has the shape of a plate made of rubber or the like. The cap 7 is used for a so-called ink suction operation (recovering operation) of sucking ink from the nozzles by driving a communication pump (not shown) along with a function of protection of the nozzles. The wiper blade 8 is used for a so-called wiping operation of wiping the ink attached to the nozzle forming surface therefrom.

Each of the ink cartridges 11*a* to 11*d* has a configuration including a flexible ink container in an airtight plastic case. The ink cartridges 11*a* to 11*d* supply ink by application of pressure to the ink using pressurized air that is sent from a pressurizing pump unit 14 through air-communicating tubes 15*a* to 15*d*. The pressurized ink is depressurized by pressure control units 13*a* to 13*d* that are mounted on the liquid ejecting head 10 and is supplied to the liquid ejecting head 10 under a negative pressure (a pressure lower than the atmosphere pressure).

Configuration of Liquid Ejecting Head

Figure 3:
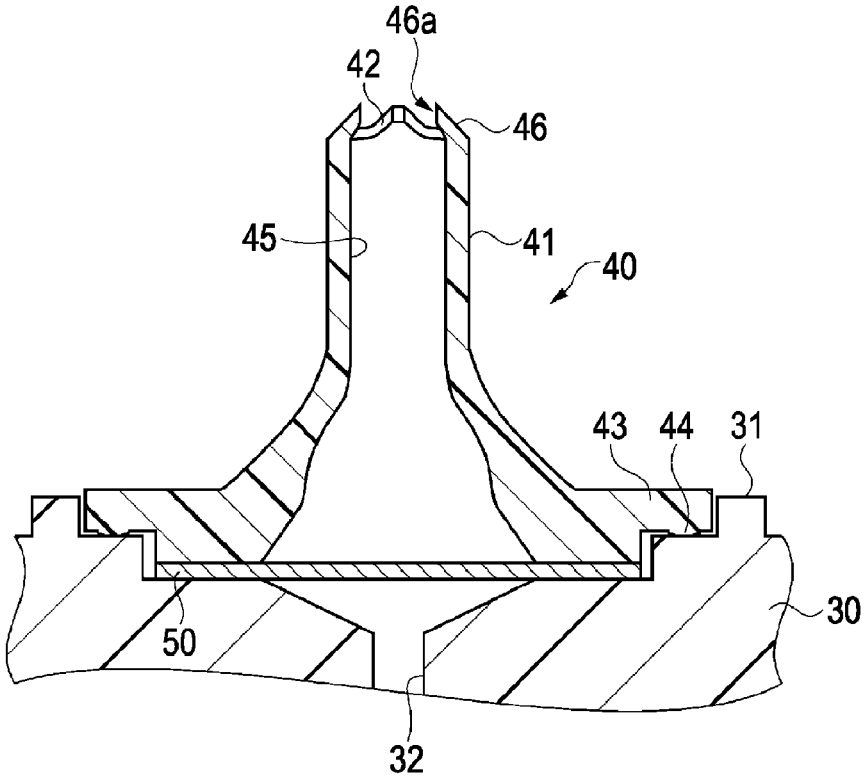
FIG. 3 is a section view showing the structure in the vicinity of an ink introducing member according to an embodiment of the invention.
Figure 4:
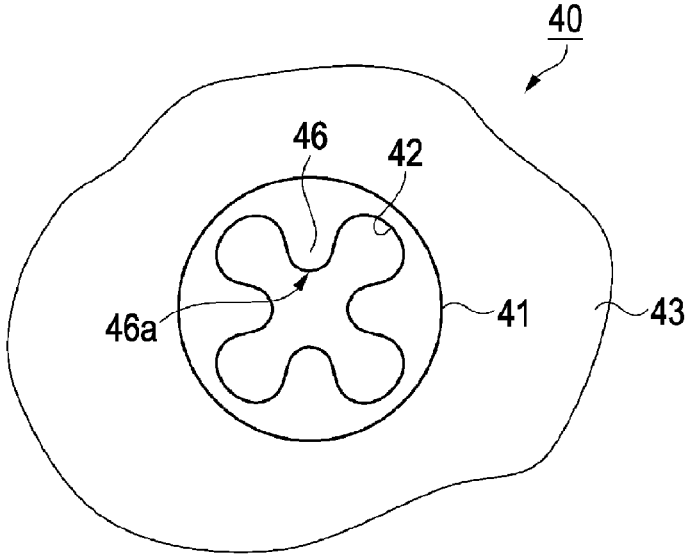
FIG. 4 is a plan view showing the structure of a liquid introducing member.

Next, the configuration of the liquid ejecting head will be described with reference to FIGS. 2, 3, and 4.

Figure 2:
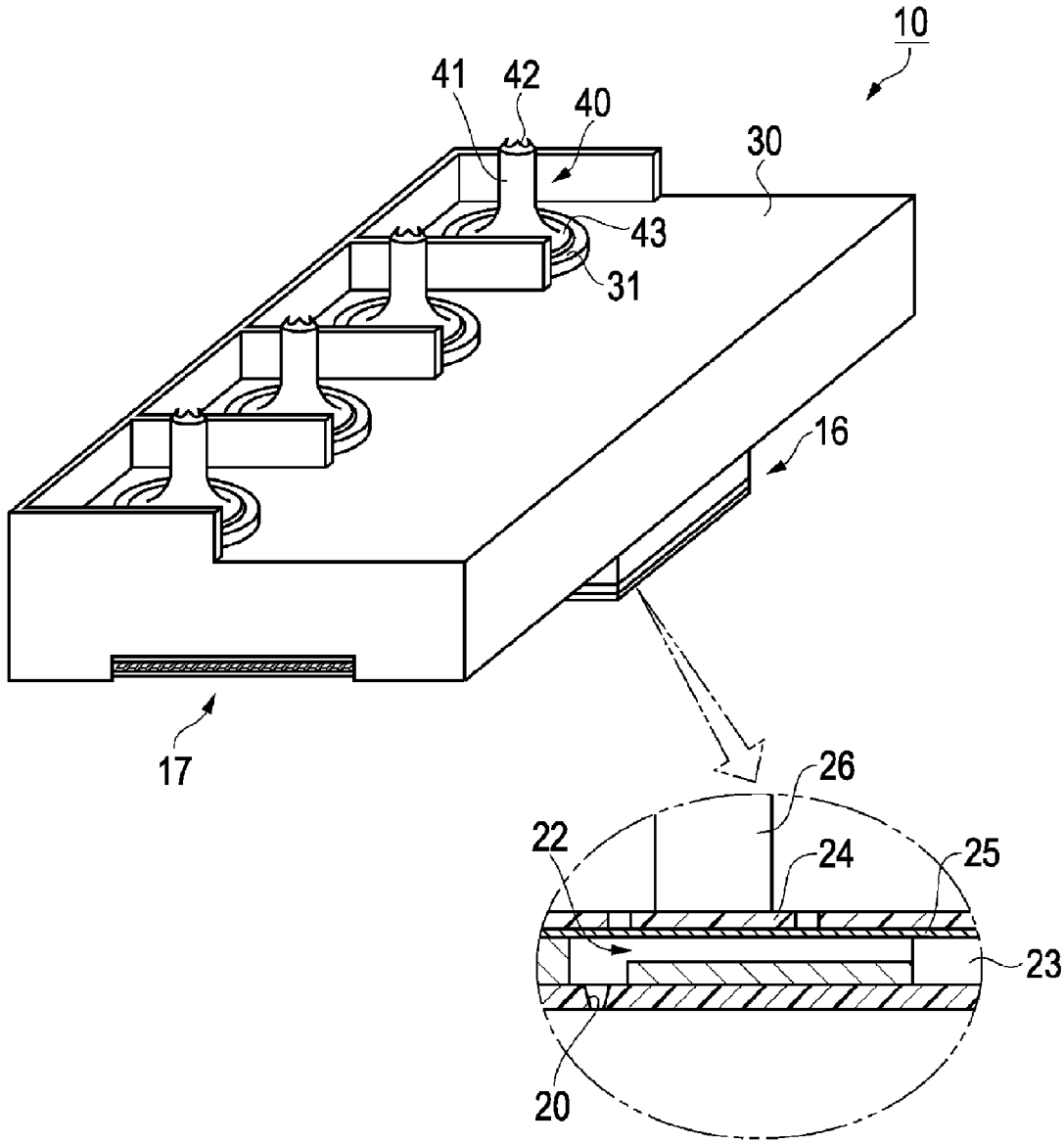
FIG. 2 is a diagram showing the whole configuration of a liquid ejecting head according to an embodiment of the invention.

FIG. 2 is a diagram showing the whole configuration of the liquid ejecting head. FIG. 3 is a sectional view showing the structure in the vicinity of an ink introducing member. FIG. 4 is a plan view showing the structure of the liquid introducing member.

The liquid ejecting head 10 includes a case 30 as a base body in which a guiding rib or a recessed portion (partially omitted in drawing) is formed such that the pressure control units 13*a* to 13*d* (See FIG. 1) can be mounted therein. Under the bottom of the case 30, an ejection section 16 for ejection of the ink and an electric circuit section 17 having a control circuit related to the ejection are provided.

The ejection section 16 includes nozzles 20 that are formed on one side in a predetermined arrangement, cavities 22 that communicate with the corresponding nozzles 20, and reservoirs 23 that supply ink to the cavities 22 for each corresponding ink type. A top cover portion 24 of each cavity 22 is configured to be moved by a flexible membrane 25, and ink is ejected from the nozzles 20 by correspondingly driving piezoelectric sensors 26 that are bonded to the corresponding top cover portions 24.

On the top face of the case 30, ink introducing members 40 are provided as liquid introducing members for introducing ink in combination with the pressure control units 13*a* to 13*d*. Each ink introducing member 40 includes a protruding portion 41 that protrudes upward in the shape of a cylinder and a flange portion 43 having a wide end portion in the case side 30. The flange portion 43 of the ink introducing member 40 is welded (fused) to the case 30 using an ultrasonic welding method with its outer circumference face regulated by a guide portion 31. Under the bottom surface of the flange portion 43, a welding protrusion 44 (in a pressed status due to welding in FIG. 3) is formed as an operation portion at a time when the ultrasonic welding is performed.

In an end portion of the protruding portion 41, an introduction hole 42 that is formed to be large in the center of the protruding portion 41 and an extending section 46 that extends to be tilted inside the introduction hole 42 from the outer edge of the introduction hole 42 is provided. As shown in the figure, four extending sections 46 disposed to be symmetrical with respect to the introduction hole 42 are provided, and the front ends 46*a* of the extending sections 46 have a round shape.

The end portion of the protruding portion 41 does not have a partition wall portion, that is a structure according to known technology, around the introduction hole 42, and accordingly, shows excellent resistance to ultrasonic welding. In addition, since the front end 46*a* of the extending section 46 has a round shape, the concentration of the ultrasonic energy in the front end 46*a* of the extending section 46 is suppressed. Accordingly, the damage of the extending section 46 at a time when the ultrasonic welding is performed is suppressed appropriately.

The ink introducing member 40 includes an introduction flow path 45 therein. One end of the introduction flow path 45 communicates with the introduction hole 42, and the other end of the introduction hole is widened and communicates with a supply flow path 32 through a filter 50 on the case 30 side. The ink introduced through the introduction hole 42 is supplied to the ejection section 16 through an introduction flow path 45, a filter 50, and a supply flow path 32.

As a material for the case 30 and the ink introduction member 40, a resin such as PPE (Poly Phenylene Ether) that is appropriate for molding and welding, a mixed material in which a glass material is mixed with a resin, or the like is used.

The filter 50 is a member formed by weaving metal wires into a mesh and is welded to a communication hole forming face of the supply flow path 32. The filter 50 performs a function of trapping foreign bodies included in the ink that is supplied to the supply flow path 32 from the introduction flow path 45. The reason that the introduction flow path 45 and the supply flow path 32 on the filter 50 side are widened is for reducing the flow resistance (water head loss) of the ink related to passing though the filter by increasing the effective area of the filter 50.

Combination of Liquid Ejecting Head and Pressure Control Unit

Next, the combination of the liquid ejecting head and the pressure control unit will be described with reference to FIG. 5.

Figure 5A:
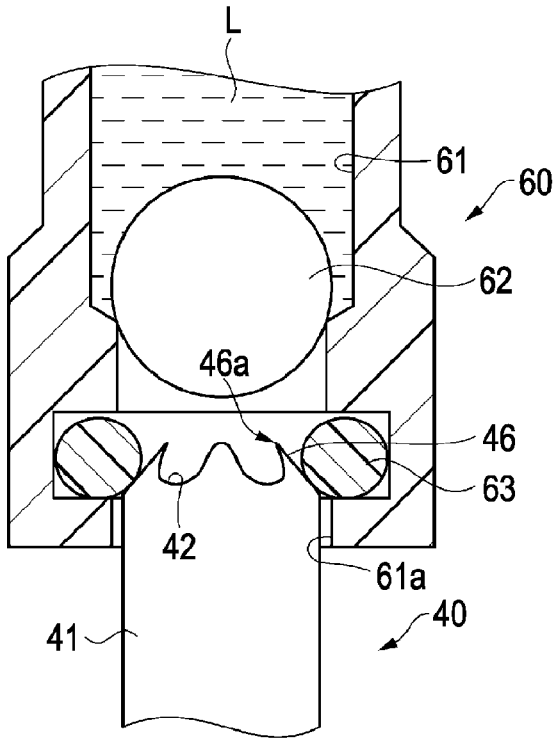
FIGS. 5A and 5B are diagrams showing a combining process of an ink supply portion and an ink introducing member according to an embodiment of the invention.
Figure 5B:
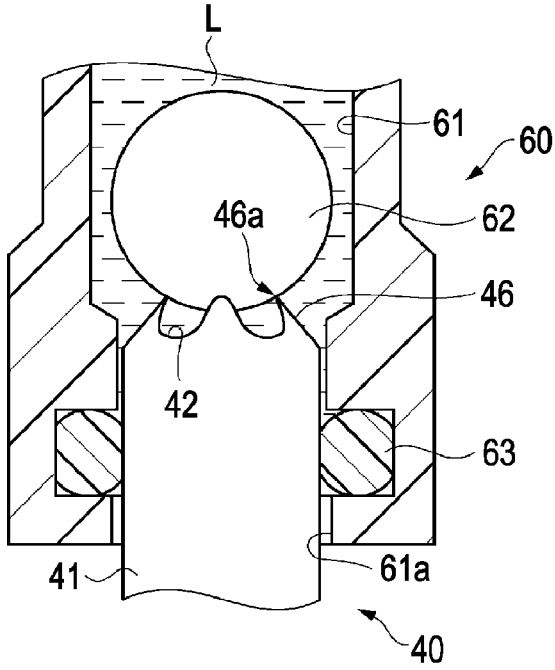

FIGS. 5A and 5B are diagrams showing a process of combining the ink supply portion and the ink introducing member.

Under the pressure control units 13*a* to 13*d* (See FIG. 1), as shown in FIGS. 5A and 5B, an ink supply portion 60 for supplying ink L is provided. The ink supply portion 60 includes a supply flow path 61 for supplying the ink, a ball valve 62 capable of partially closing the supply flow path 61, and an O ring 63 for sealing a connection portion between the ink introduction member 40 and the ink supply portion 60.

In a status shown in FIG. 5A, the ball valve 62 closes the supply flow path 61, and the inner diameter of the O ring 63 is configured to be slightly smaller than the outer diameter of the protruding portion 41 of the ink introduction member 40. As shown in the figure, when the protruding portion 41 of the ink introduction member 40 is inserted into the ink supply portion 60, the extending section 46 that is formed to be tilted from the outer edge of the introduction hole 42 to the inside of the introduction hole guides the insertion position of the protruding portion 41 between the opening portion 61*a* of the supply flow path 61 and the inner face of the O ring 63.

When the extending section 46 functions as a guide for the insertion position, the front end 46*a* of the extending section 46 has a round shape, and accordingly, damage to the opening portion 61*a* of the supply flow path 61 or the O ring 63 does not happen. In addition, since a plurality (four in this embodiment) of extending sections 46 are disposed to be symmetrical with respect to the center of the introduction hole 42, the protruding portions 41 are guided without inclining to one side of one of the positions of the plurality of extending sections 46.

As shown in FIG. 5B, when the ink introduction member 40 is additionally inserted into the ink supply portion 60, the O ring 63 tightly contacts the peripheral surface of the protruding portion 41 to seal the connection portion. In addition, the extending section 46 formed in the end portion of the protruding portion 41 lifts the ball valve 62 upward to be in a status that the supply flow path 61 is opened.

Since the extending section 46 is formed to extend from the outer edge of the introduction hole 42, as shown in the figure, even in a status that the ball valve 62 is lifted upward, the whole introduction hole 42 is not closed by the ball valve 62, and the ink L can be introduced through the introduction hole 42. In addition, since the introduction hole 42 can be formed to be sufficiently large in the center of the end portion of the protruding portion 41, a high pressure loss (flow resistance) does not occur at a time when the ink L is introduced. In addition, since the ink introduction member 40 according to an embodiment of the invention has a structure in which an upper side is largely opened as the introduction hole 42, air bubbles cannot stay locally in the introduction flow path 45 (See FIG. 3), and accordingly, there is no case in which the air bubbles flow in the nozzle during a printing operation thereby causing inferior ejection.

Modification

Next, a modified example will be described with focus on the difference from the above-described embodiment, with reference to FIG. 6.

Figure 6:
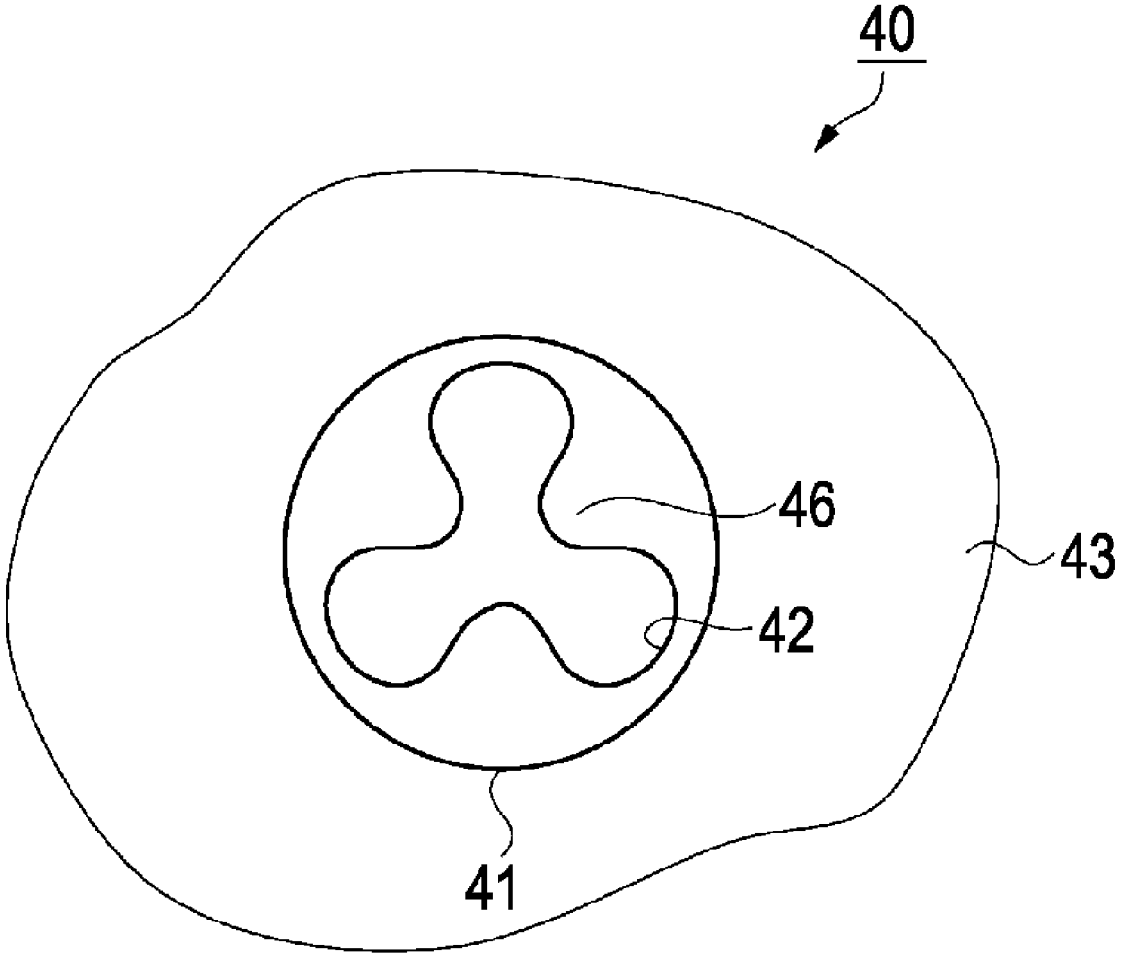
FIG. 6 is a plan view showing the structure of an ink introduction member according to a modified example.

FIG. 6 is a plan view showing the structure of an ink introduction member according to a modified example.

As shown in FIG. 6, three extending sections 46 of the ink introduction member 40 according to the modified example are prepared to be symmetrical with respect to the center of the introduction hole 42, and the extending sections 46 are formed to be larger than those of the above-described embodiment. As in this modified example, the number or form of the extending sections 46 according to an embodiment of the invention is not limited to the above-described embodiment and may be changed into various forms without departing from the gist of the invention.

The present invention is not limited to the above-described embodiments.

For example, the invention may be applied to a so-called on-carriage type printer that performs printing by directly mounting an ink cartridge on a carriage (liquid ejecting head) or a drawing apparatus that is used for patterning/disposing various functional liquids on a substrate or the like for an industrial use.

As a structure of the ink supply portion that is to be combined with the ink introduction member, a structure that does not include a ball valve may be used.

In addition, the configurations in the embodiments of the invention may be combined, omitted, or combined with another configuration that is not shown in the figures appropriately.

What is claimed is:

1. A liquid ejecting head which is formed by joining a liquid introducing member for introducing liquid and a base body, the liquid ejecting head comprising:

an introduction hole which is formed in a front end of the liquid introducing member; and an extending section which is tilted to extend from the exterior edge of an introduction hole to the inside of the introduction hole, wherein the front end of the extending section has a round shape.

2. The liquid ejecting head according to claim 1, wherein the extending section is a plurality of extending sections disposed to be symmetrical with respect to the introduction hole.

3. The liquid ejecting head according to claim 2, wherein the number of extending sections is three to four.

4. A liquid ejecting apparatus comprising the liquid ejecting head according to claim 1.

* * * * *